US010103445B1

(12) United States Patent
Gregoire et al.

(10) Patent No.: US 10,103,445 B1
(45) Date of Patent: Oct. 16, 2018

(54) CAVITY-BACKED SLOT ANTENNA WITH AN ACTIVE ARTIFICIAL MAGNETIC CONDUCTOR

(71) Applicant: HRL Laboratories, LLC, Malibu, CA (US)

(72) Inventors: Daniel J. Gregoire, Thousand Oaks, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 440 days.

(21) Appl. No.: 13/910,039

(22) Filed: Jun. 4, 2013

Related U.S. Application Data

(60) Provisional application No. 61/655,670, filed on Jun. 5, 2012.

(51) Int. Cl.
*H01Q 13/18* (2006.01)
*H01Q 13/10* (2006.01)

(52) U.S. Cl.
CPC ..... *H01Q 13/103* (2013.01); *H01Q 13/18* (2013.01)

(58) Field of Classification Search
CPC .... H01Q 15/148; H01Q 15/18; H01Q 15/103; H01Q 15/10; H01Q 15/00; H01Q 15/0006; H01Q 15/0013; H01Q 15/002; H01Q 15/006; H01Q 15/0066; H01Q 15/142; H01Q 13/10; H01Q 13/18; H01Q 13/103; H01Q 15/0086; H01Q 21/065
USPC ..... 343/767, 789, 846, 909, 771, 770
See application file for complete search history.

(56) References Cited

U.S. PATENT DOCUMENTS

| | | | | |
|---|---|---|---|---|
| 4,234,960 | A | 11/1980 | Spilsbury et al. | |
| 4,904,952 | A | 2/1990 | Tanimoto | |
| 5,311,198 | A * | 5/1994 | Sutton | H01Q 1/242 343/701 |
| 5,392,002 | A | 2/1995 | Delano | |
| 5,489,878 | A | 2/1996 | Gilbert | |
| 6,081,167 | A | 6/2000 | Kromat | |
| 6,121,940 | A * | 9/2000 | Skahill | H01Q 9/00 343/701 |
| 6,411,261 | B1 | 6/2002 | Lilly | |
| 6,476,771 | B1 * | 11/2002 | McKinzie | H01Q 1/425 333/134 |
| 6,483,480 | B1 | 11/2002 | Sievenpiper et al. | |
| 6,509,875 | B1 * | 1/2003 | Nair | H01Q 1/243 343/700 MS |

(Continued)

FOREIGN PATENT DOCUMENTS

| | | |
|---|---|---|
| CN | 101853974 A | 10/2010 |
| CN | 102005648 A | 4/2011 |

(Continued)

OTHER PUBLICATIONS

Satellite Communications Payload and System, by Teresa M. Braun, Sep. 2012.*

(Continued)

*Primary Examiner* — Hoang Nguyen
*Assistant Examiner* — Awat Salih
(74) *Attorney, Agent, or Firm* — Ladas & Parry

(57) ABSTRACT

A cavity-backed slot antenna whose cavity has an artificial magnetic conductor (AMC) disposed therein, the AMC being loaded with active reactive elements. The active reactive elements are preferably formed by Non-Foster Circuits (NFCs).

17 Claims, 10 Drawing Sheets

(56) References Cited

U.S. PATENT DOCUMENTS 6,518,930 B2* 2/2003 Itoh ..... H01Q 1/38 343/700 MS
6,525,695 B2 2/2003 McKinzie
6,538,621 B1 3/2003 Sievenpiper et al.
6,768,472 B2 7/2004 Alexopoulos et al.
6,917,343 B2 7/2005 Sanchez et al.
6,952,565 B1 10/2005 Takeda et al.
7,042,419 B2* 5/2006 Werner et al. ..... 343/909
7,245,269 B2 7/2007 Sievenpiper et al.
7,388,186 B2 6/2008 Berg et al.
7,429,961 B2 9/2008 Sievenpiper
7,586,384 B2 9/2009 Ranta
7,619,568 B2* 11/2009 Gillette ..... H01Q 1/38 343/700 MS
7,847,633 B2 12/2010 Kinget
7,852,174 B2 12/2010 Cathelin et al.
7,880,568 B2 2/2011 Amin et al.
7,941,022 B1 5/2011 Schaffner et al.
8,111,111 B2 2/2012 Van Bezooijen
8,263,939 B2 9/2012 Delaney et al.
8,358,989 B2 1/2013 Kakuya et al.
8,374,561 B1 2/2013 Yung et al.
8,436,785 B1 5/2013 Lai et al.
8,451,189 B1 5/2013 Fluhler
8,471,776 B2* 6/2013 Das ..... H01Q 3/30 343/770
8,639,203 B2 1/2014 Robert et al.
8,912,711 B1 12/2014 Chang
8,957,831 B1* 2/2015 Gregoire ..... H01Q 15/004 343/700 MS
8,959,831 B2* 2/2015 Smith ..... 43/123
8,976,077 B2* 3/2015 Colburn et al. ..... 343/909
8,988,173 B2 3/2015 Hitko et al.
9,093,753 B2 7/2015 Jung et al.
9,250,074 B1 2/2016 Kubena
9,379,448 B2 6/2016 Gregoire
2001/0050641 A1* 12/2001 Itoh ..... H01Q 1/38 343/700 MS
2002/0041205 A1 4/2002 Oppelt
2002/0167457 A1 11/2002 McKinzie et al.
2003/0020655 A1* 1/2003 McKinzie, III ..... H01Q 1/38 343/700 MS
2003/0112186 A1* 6/2003 Sanchez ..... H01Q 3/44 343/700 MS
2004/0056814 A1* 3/2004 Park ..... H01Q 21/0006 343/771
2004/0227667 A1 11/2004 Sievenpiper
2004/0227668 A1 11/2004 Sievenpiper
2004/0263420 A1* 12/2004 Werner ..... H01Q 1/38 343/909
2005/0146475 A1* 7/2005 Bettner ..... G06F 1/1616 343/767
2005/0184922 A1 8/2005 Ida et al.
2006/0017651 A1* 1/2006 Werner ..... H01Q 9/16 343/909
2007/0182639 A1 8/2007 Sievenpiper et al.
2008/0088390 A1 4/2008 Cathelin et al.
2008/0094300 A1* 4/2008 Lee ..... H01Q 21/065 343/844
2008/0164955 A1 7/2008 Pfeiffer et al.
2008/0169992 A1 7/2008 Ortiz
2008/0242237 A1 10/2008 Rofougaran et al.
2008/0284674 A1 11/2008 Herz et al.
2009/0025973 A1 1/2009 Kazantsev et al.
2010/0039111 A1* 2/2010 Luekeke ..... G01R 33/341 324/318
2010/0039343 A1* 2/2010 Uno et al. ..... 343/818
2010/0149430 A1 6/2010 Fulga et al.
2010/0225395 A1 9/2010 Patterson
2010/0231470 A1* 9/2010 Lee et al. ..... 343/722
2010/0238085 A1* 9/2010 Fuh ..... H01Q 13/22 343/771
2011/0018649 A1 1/2011 David et al.
2011/0090128 A1* 4/2011 Sulima ..... H01Q 13/12 343/767
2011/0115584 A1* 5/2011 Kiji ..... H01Q 15/142 333/81 R
2012/0256811 A1* 10/2012 Colburn ..... H01Q 15/148 343/907
2012/0287006 A1* 11/2012 Lenormand ..... H01Q 1/3275 343/771
2013/0009720 A1* 1/2013 White et al. ..... 333/17.3
2013/0009722 A1 1/2013 White et al.
2013/0200947 A1 8/2013 Alexopoulos et al.
2013/0268250 A1* 10/2013 Werner ..... G06F 17/5009 703/2
2015/0244079 A1* 8/2015 White ..... H01Q 15/0086 343/913
2015/0244080 A1 8/2015 Gregoire et al.
2015/0263432 A1* 9/2015 White ..... H01Q 15/0066 343/913

FOREIGN PATENT DOCUMENTS

EP 0295704 A2 12/1988
EP 2290745 A1 3/2011
GB 2288502 A 10/1995
JP 2008 278159 A 11/2008
TW 200845482 11/2008
WO 2004/013933 2/2004
WO WO 2004/013933 * 12/2004
WO 2006/054246 5/2006
WO 2009/090244 A1 7/2009

OTHER PUBLICATIONS

A Coaxial TEM Cell for Direct Measurement of UHF Artificial Magnetic Conductors, by Gregoire et al., Apr. 2012.*
From U.S. Appl. No. 14/335,737 (Unpublished, Non-Publication Requested), Non-Final Rejection dated Dec. 30, 2015.
U.S. Appl. No. 14/547,057, filed Nov. 18, 2014, Kubena.
From U.S. Appl. No. 14/335,737 (unpublished, non publication requested), Notice of Allowance dated Mar. 11, 2016.
From U.S. Appl. No. 14/547,057 (unpublished, non publication requested), Office Action dated Jun. 15, 2016.
From U.S. Appl. No. 14/188,225 (published as US 2015-0244080 and now U.S. Pat. No. 9,379,448), Notice of Allowance dated Mar. 11, 2016.
From U.S. Appl. No. 14/628,076 (published as US 2015-0263432 A1), Office Action dated Aug. 22, 2016.
From U.S. Appl. No. 14/628,076 (published as US 2015-0263432 A1), Office Action dated Apr. 20, 2016.
He, et al., "3D broadband isotropic NRI metamaterial based on metallic cross-pairs," Journal of Magnetism and Magnetic Materials, vol. 323, Issue 20, Oct. 2011, pp. 2425-2428.
Office Action dated Jun. 22, 2016 from Chinese Patent Application No. 201280021746 with brief English Summary.
Office Action dated Jan. 7, 2016 from Chinese Patent Application No. 201280021746 with English Summary.
Office Action dated Nov. 17, 2015 from Chinese Patent Application No. 201280033448.2 with Brief English Summary.
Office Action from Chinese Patent Application No. 201480072872.7 dated Feb. 4, 2017 and its English translation.
Dong, Anhong, "Frequency Selection Surfaces Design Based on Substrate Integrated Waveguide," Nanjing University of Science and Technology, Mar. 18, 2013, pp. 6, 7, 21, and 22 (and its English abstract).
Yao, Bofeng, "Study of Thin Absorbing Structures Using Metamaterials." Xidian University, Dec. 2010, pp. 33-34 (and its English translation OCR by Adobe Acrobat X Pro, Google Translate).
Office Action from Chinese Patent Application No. 201480072872.7 dated Jul. 3, 2017 and its English translation.
EPO extended search report from European Patent Application No. 14882944.3 dated Sep. 28, 2017.
From U.S. Appl. No. 14/997,423 (unpublished, non publication requested), Office Action dated Nov. 1, 2017.

(56) References Cited

OTHER PUBLICATIONS

Office Action from Chinese Patent Application No. 201480072872.7 dated Aug. 29, 2017 and its English translation.
U.S. Appl. No. 13/910,039, filed Jun. 4, 2013, Gregoire et al.
U.S. Appl. No. 14/188,225, filed Feb. 24, 2014, Gregoire et al.
U.S. Appl. No. 14/188,264, filed Feb. 24, 2014, White et al.
U.S. Appl. No. 14/628,076, filed Feb. 20, 2015, White et al.
U.S. Appl. No. 14/335,737, filed Jul. 18, 2014, White et al.
Adonin, A.S., K. o. Petrosjanc, I. V. Poljakov, "Monolith Optoelectronic Integrated Circuit With Built-In Photovoltaic Supply for Control and Monitoring," 1998 IEEE International Conference on Electronics, Circuits and Systems, vol. 2, pp. 529-531, (1998).
Bezooijen, et al. "RF-MEMS based adaptive antenna matching module," IEEE Radio Frequency Integrated Circuits Symposium, p. 573-576, 2007.
Brennan, et al., "The CMOS negative impedance converter", *IEEE Journal of Solid-State Circuits*, 32(5), Oct. 1988.
Chen, Ying et al., "Wideband Varactorless LC VCO Using a Tunable Negative-Inductance Cell" , IEEE Transactions on Circuits and Systems, I: Regular Papers, IEEE, US, vol. 57, No. 10, Oct. 1, 2010, pp. 2609-2617 and II. A Principle of Tunable NI Cell, p. 2609.
Chinese Office Action dated Dec. 2, 2014 from Chinese Patent Application No. 201280021746 with English summary.
Chinese Office Action dated Oct. 27, 2014 from Chinese Patent Application No. 2012800334482 with English translation.
Colburn, J.S., et al., "Adaptive Artificial Impedance Surface Conformal Antennas", *Proc. IEEE Antennas and Propagation Society Int. Symp.*, 2009, pp. 1-4.
Costa, F. et al., "On the bandwidth of high-impedance frequency selective surfaces", IEEE AWPL, vol. 8, pp. 1341-1344, 2009.
Cyril Svetoslavov Mechkov, "A heuristic approach to teaching negative resistance phenomenon," *Third International Conference—Computer Science '06*, Istanbul, Turkey, Oct. 12-15, 2006 (6 pgs).
EPO Extended Search Report with Search Opinion dated Mar. 19, 2015 from European Patent Application No. 12806913.5.
EPO Supplementary European Search Report with European Search Opinion dated Jul. 29, 2014 from European Patent Application No. 12767559.3.
EPO Supplementary European Search Report with European Search Opinion dated Oct. 8, 2014 from European Patent Application No. 12768357.1.
Fong, B.H., et al., "Scalar and tensor holographic artificial impedance surfaces", *Trans. Antennas and Propag.*, vol. 58, pp. 3212-3221, Oct. 2010.
Foster, R. M. "A reactance theorem", Bell Systems Technical Journal, vol. 3, pp. 259-267, 1924.
From U.S. Appl. No. 13/910,039 (unpublished, non publication requested), Office Action dated Jun. 15, 2015.
From U.S. Appl. No. 12/768,563 (now U.S. Pat. No. 8,374,561), Notice of Allowance dated Oct. 9, 2012.
From U.S. Appl. No. 12/768,563 (now U.S. Pat. No. 8,374,561), Non-Final Office Action dated Jun. 13, 2012.
From U.S. Appl. No. 12/768,563 (now U.S. Pat. No. 8,374,561), Notice of Allowance dated Oct. 23, 2012.
From U.S. Appl. No. 13/177,479 (now U. S. Publication No. 2013-0009720 A1), Non-Final Office Action dated Dec. 2, 2014.
From U.S. Appl. No. 13/177,479 (now U. S. Publication No. 2013-0009720 A1), Non-Final Office Action dated Jun. 4, 2014.
From U.S. Appl. No. 13/441,659 (now U. S. Publication No. 2012-0256811 Al), Final Office Action dated Jul. 1, 2014.
From U.S. Appl. No. 13/441,659 (now U. S. Publication No. 2012-0256811 A1), Non-Final Office Action dated Feb. 24, 2014.
From U.S. Appl. No. 13/441,659 (now U. S. Publication No. 2012-0256811 A1), Notice of Allowance dated Oct. 30, 2014.
From U.S. Appl. No. 13/441,730 (now U. S. Publication No. 2012-0256709 A1), Non-Final Office Action dated Mar. 13, 2014.
From U.S. Appl. No. 13/441,730 (now U. S. Publication No. 2012-0256709 A1), Notice of Allowance dated Jul. 28, 2014.
From U.S. Appl. No. 13/441,730 (now U. S. Publication No. 2012-0256709 A1), Notice of Allowance dated Nov. 10, 2014.
From U.S. Appl. No. 13/472,396 (now U. S. Publication No. 2013-0009722 A1), Final Office Action dated Apr. 9, 2015.
From U.S. Appl. No. 13/472,396 (now U. S. Publication No. 2013-0009722 A1), Non-Final Office Action dated Dec. 2, 2014.
From U.S. Appl. No. 13/472,396 (now U. S. Publication No. 2013-0009722 A1), Non-Final Office Action dated Jul. 30, 2014.
From U.S. Appl. No. 14/188,225, filed Feb. 24, 2014; unpublished, Application and Office Actions.
From U.S. Appl. No. 14/188,264, filed Feb. 24, 2014; unpublished, Application and Office Actions.
From U.S. Appl. No. 14/628,076, filed Feb. 20, 2015; unpublished, Application and Office Actions.
Gower, John, Optical Communications Systems, 2nd edition, Prentice Hall, 1993, pp. 40-46.
Gregoire, D. J.; Colburn, J. S.; White, C. R.; , "A coaxial TEM cell for direct measurement of UHF artificial magnetic conductors", IEEE Antenna and Propagation Magazine, 54, 251-290, 2012.
Gregoire, D.J. et al. "Non-foster metamaterials", *Antenna Applications Symposium 2011*, Sep. 2011.
Gregoire, Daniel J., et al., "Wideband Artificial Magnetic Conductors Loaded With Non-Foster Negative Inductors", IEEE Antennas and Wireless Propagation Letters, IEEE, Piscataway, NJ, US, vol. 10, Dec. 26, 2011 (Dec. 26, 2011), pp. 1586-1589.
Hrabar S., et al., "Towards active dispersion less ENZ metamaterial for cloaking applications", Metamaterials, Elsevier BV, NL, vol. 4, No. 2-3, Aug. 1, 2010 (Aug. 1, 2010), pp. 89-97.
International Preliminary Report on Patentability for PCT/US2012/032648 dated Oct. 17, 2013.
International Preliminary Report on Patentability for PCT/US2012/045632 dated Jul. 10, 2013.
International Preliminary Report on Patentability for PCT/US2012/32638 dated Jun. 27, 2013.
International Search Report and Written Opinion for PCT/US/2012/032638 dated Oct. 29, 2012.
International Search Report and Written Opinion for PCT/US2012/032648 dated Dec. 14, 2012.
International Search Report and Written Opinion for PCT/US2012/045632 dated Jan. 10, 2013.
International Search Report and Written Opinion for PCT/US2014/072233 dated Mar. 16, 2015.
Kern D. J., et al., "Design of Reconfigurable Electromagnetic Bandgap Surfaces as Artificial Magnetic Conducting Ground Planes and Absorbers", Antennas and Propagation Society International Symposium 2006, IEEE Albuquerque, NM, USA Jul. 9-14, 2006, Piscataway, NJ, USA, IEEE, Piscataway, NJ, USA, Jul. 9, 2006 (Jul. 9, 20069), pp. 197-200.
Kern, D.J. et al., "Active negative impedance loaded EBG structures for the realization of ultra-wideband artificial magnetic conductor", *Proc. IEEE Antennas and Propagation Society Int. Symp.*, 2003, pp. 427-430.
Linvill, J.G. "Transistor negative-impedance converters", *Proceedings of the IRE*, vol. 41, pp. 725-729, Jun. 1953.
Luukkonen, O. et al, "Simple and accurate analytical model of planar grids and high-impedance surfaces", IEEE Trans. Antennas Propagation, vol. 56, 1624, 2008.
Mirzaei, H, et al.: "A wideband metamaterial-inspired compact antenna using embedded non-Foster matching," Antennas and Propagation (APSURSI), 2011 IEEE International Symposium on, IEEE. Jul. 3, 2011 (Jul. 3, 2011), pp. 1950-1953.
Office Action dated Jun. 8, 2015 from Chinese Patent Application No. 201280033448.2 with machine English translation.
Pozar, David M., *Microwave Engineering*, Second Edition, John Wiley & Sons, Inc., 1998, pp. 89-90 and 629-631 with table of contents (16 pages).
Ramirez-Angulo, J. et al.: "Simple technique using local CMFB to enhance slew rate and bandwidth of one-stage CMOS op-amps", Electronics Letters, IEE Stevenage, GB, vol. 38, No. 23, Nov. 7, 2002, pp. 1409-1411.
Sandel, B., Radio Frequency Amplifiers, A.S.T.C., Chapter 23, pp. 912-946, 1960.
Sievenpiper, D. et al., "High-impedance electromagnetic surfaces with a forbidden frequency band," IEEE Trans. Microwave Theory Tech., vol. 47, pp. 2059-2074, Nov. 1999.

(56) References Cited

OTHER PUBLICATIONS

Song, K. and Rojas, R.G., "Non-foster impedance matching of electrically small antennas," *Proc. IEEE Ant. Prop. Int. Symp*., Jul. 2010.
Staple, et al. "The End of Spectrum Scarcity," published by IEEE Spectrum, Mar. 2004, pp. 1-5.
Stearns, S. "Non-Foster circuits and stability theory," *Proceedings IEEE Antennas and Proagation Int. Symposium*, 2011, pp. 1942-1945.
Sussman-Fort, S. E. "Gyrator-Based Biquad Filters and Negative Impedance Converters for Microwaves," *International Journal of RF and Microwave Computer-Aided Engineering*, vol. 8 (2): pp. 86-101, 1998.
Sussman-Fort, S.E. "Matching Network Design Using Non-Foster Impedances," *International Journal of RF and Microwave Computer-Aided Engineering*, vol. 16, Issue 2, pp. 135-142, Feb. 2006.
Sussman-Fort, S.E. and R. M, Rudish, "Non-Foster Impedance Matching of Electrically Small Antennas," IEEE Trans. Antennas and Propagation, vol. 57, No. 8, pp. 2230-2241, (Aug. 2009).
Sussman-Fort, S.E. and R.M. Rudish. EDO Corporation, "Increasing efficiency or bandwidth of electrically small transmit antennas by impedance matching with non-foster circuits", Progress in Electromagnetics Research Symposium 2006, Cambridge, USA, Mar. 26-29, (23 pages) 2006.
Sussman-Fort, S.E., Ph.D, Slideshow for "Matching Network Design Using Non-Foster Impedances" EDO Corporation (printed from the Internet on Jun. 30, 2011) (43 pages).
Sussman, S.E. and Rudish, R.M., "Non-Foster Impedance matching for transmit applications," *IEEE Xplore*, EDO Corporation and Dept. of Electrical and Computer Engineering. pp. 53-56, Mar. 6-8, 2006.
White et al.; "A variable negative-inductance integrated circuit at UHF frequencies," *Microwave and Wireless Components Letters*, IEEE , vol. 22, No. 1, 35-37, Jan. 2012.
White Paper by the Virginia Tech Antenna Group of Wireless @ Virgina Tech "Non-Foster Reactance Matching for Antennas," pp. 1-5 <http://wireless.vt.edu/research/Antennas_Propagation/Whitepapers/Whitepaper-Non-Foster_Reactance_Matching_for_Antennas.pdf>.
White, C.R. and Rebeiz, G.M., "A shallow varactor-tuned cavity-backed-slot antenna with a 1.9:1 tuning range," IEEE Trans. Antennas Propagation, 58(3), 633-639, Mar. 2010.
From U.S. Appl. No. 14/335,737, filed Jul. 18, 2014; unpublished, non publication requested), Office Action dated Jun. 15, 2015.
Office Action dated Jul. 22, 2015 from Chinese Patent Application No. 201280021746.X with brief English summary.
From U.S. Appl. No. 14/188,225 (Now Published as 2015/0244080), Non-Final Rejection dated Nov. 3, 2015.
U.S. Appl. No. 14/856,541, filed Sep. 16, 2015, Gregoire.
From U.S. Appl. No. 14/856,541, filed Sep. 16, 2015; unpublished; non publication request filed, Application and Office Actions.
From U.S. Appl. No. 13/472,396 (now published as US 2013-0009722 A1), Office Action dated Sep. 11, 2015.
Office Action from Chinese Patent Application No. 201280021449.5 dated Sep. 29, 2015 with brief English summary.

* cited by examiner

NFCSchematic

Measured NFCCircuit Parameters

CAVITY-BACKED SLOT ANTENNA WITH AN ACTIVE ARTIFICIAL MAGNETIC CONDUCTOR

CROSS REFERENCE TO RELATED APPLICATIONS

This application claims the benefit of U.S. provisional patent application No. 61/655,670 filed Jun. 5, 2012, the disclosure of which is hereby incorporated by reference.

This application is also related to U.S. patent application Ser. No. 13/441,730 filed Apr. 6, 2012 and entitled "Differential Negative Impedance Converters and Inverters with Tunable Conversion Ratios", the disclosure of which is hereby incorporated by reference.

STATEMENT REGARDING FEDERALLY SPONSORED RESEARCH OR DEVELOPMENT

None.

TECHNICAL FIELD

This invention relates to cavity backed antennas.

BACKGROUND

Cavity-backed slot antennas (CBSA) have been extensively investigated for applications to airborne and satellite communications because they satisfy the requirements of flush mounting, low cost and light weight. Their optimum size scales with the wavelength of the desired radiation frequency which the antenna transmits and/or receives. In order to get the antenna to radiate efficiently, the cavity height is usually designed to be one- or three-quarter wavelengths at the resonator frequency in order not to destroy impedance matching. At low frequencies, such as the VHF and UHF bands, where the radiation wavelength is 1 m or longer, the CBSA can be very large and hard to mount on aircraft. Embodiments of the principles of the present invention described below comprise a reduced-size CBSA that radiates efficiently at low frequencies over a large bandwidth with a tunable operation band.

The prior art teaches that the CBSA cavity height can be reduced through dielectric loading but then the bandwidth and efficiency will also be reduced.

Itoh and Yang (U.S. Pat. No. 6,518,930) have disclosed a CB SA loaded with a passive Artificial Magnetic Conductor (AMC) structure. The AMC transforms the cavity ground plane into an electrically open surface, and allows the CBSA to operate at lower frequencies without an excessively deep cavity. However, the measured bandwidth of the antenna is very narrow because they use the passive AMC structure to load the CBSA.

BRIEF DESCRIPTION OF THE INVENTION

The invention is a low-profile, cavity-backed slot antenna loaded with an active artificial magnetic conductor (AAMC). The invention uses an AMC that is loaded with reactive members and preferably with non-Foster ICs (NFC) that provide a negative inductance. Some embodiments according to the principles of the present invention demonstrate that NFCs added to the AAMC grid increases the bandwidth by more than a factor of ten over a passive AMC.

In one embodiment according to the principles of the present invention, a very high frequency (VHF) CBSA with the AAMC demonstrated that it enables efficient radiation over a significantly wide bandwidth, unreported in the prior art. Since the NFC is tunable with an applied voltage, the AAMC-CBSA is tunable also. One embodiment according to the principles of the present invention is tunable from 260 MHz to 350 MHz.

The prior art embodiments show an AMC-CBSA and a very wide cavity with respect to the cavity length, i.e it has a large width to length aspect ratio and requires an AMC that is several unit cells across. Embodiments according to the principles of the present invention are narrow, less than 1/10 wavelength, and only require a single unit cell across the width.

In one aspect the present invention provides a cavity-backed slot antenna whose cavity has an artificial magnetic conductor (AMC) disposed therein, the AMC being formed by an array of metal patches displaced by a distance above a bottom of said cavity, the metal patches have edges confronting sidewalls of the cavity, said edges being electrically connected to said sidewalls, the AMC being loaded with active reactive elements.

In another aspect the present invention provides a cavity-backed slot antenna whose cavity has an artificial magnetic conductor (AMC) disposed therein, the AMC comprising an array of metal patches displaced by a set distance above a bottom of said cavity, the metal patches being arrayed in two columns running along a length of the cavity, and with a gap between the columns, the metal patches having edges confronting sidewalls of the cavity, said edges being electrically connected to said sidewalls, each gap between neighboring patches being bridged by reactive elements.

In yet another aspect the present invention provides a cavity-backed slot antenna whose cavity has an artificial magnetic conductor (AMC) disposed therein, the AMC comprising an array of metal patches displaced by a set distance above a bottom of said cavity, the metal patches being arrayed in a single column running along a length of the cavity, and with a gap between the column and sidewalls of the cavity, the metal patches having edges confronting sidewalls of the cavity, said edges being electrically coupled to said sidewalls via reactive elements.

In still yet another aspect the present invention provides a method of lowering a resonant frequency of a cavity backed slot antenna comprising the steps of: disposing a plurality of electrically conductive patches in a cavity of said cavity backed slot antenna adjacent a slot of said cavity backed slot antenna; and coupling capacitive elements (a) between opposing or neighboring ones of said electrically conductive patches and/or (b) between said plurality of electrically conductive patches and an electrically conductive wall defining at least two edges of said cavity.

In yet another aspect the present invention provides a method of increasing the bandwidth around a resonant frequency of a cavity backed slot antenna comprising the steps of: disposing an array of electrically conductive patches in a cavity of said cavity backed slot antenna adjacent a slot of said cavity backed slot antenna, the array of electrically conductive patches forming an artificial magnetic conductor; and coupling capacitive elements (a) between opposing ones of said electrically conductive patches and/or (b) between said plurality of electrically conductive patches and an electrically conductive wall defining at least two edges of said cavity, said capacitive elements each having a negative capacitance.

DETAILED DESCRIPTION

One embodiment according to the principles of the present invention, comprises a cavity-backed slot antenna (CBSA) loaded with an active artificial magnetic conductor (AAMC). The AAMC is an artificial magnetic conductor (AMC) loaded with negative inductance non-Foster circuits (NFCs).

Figures 1A, 1B, 1C:
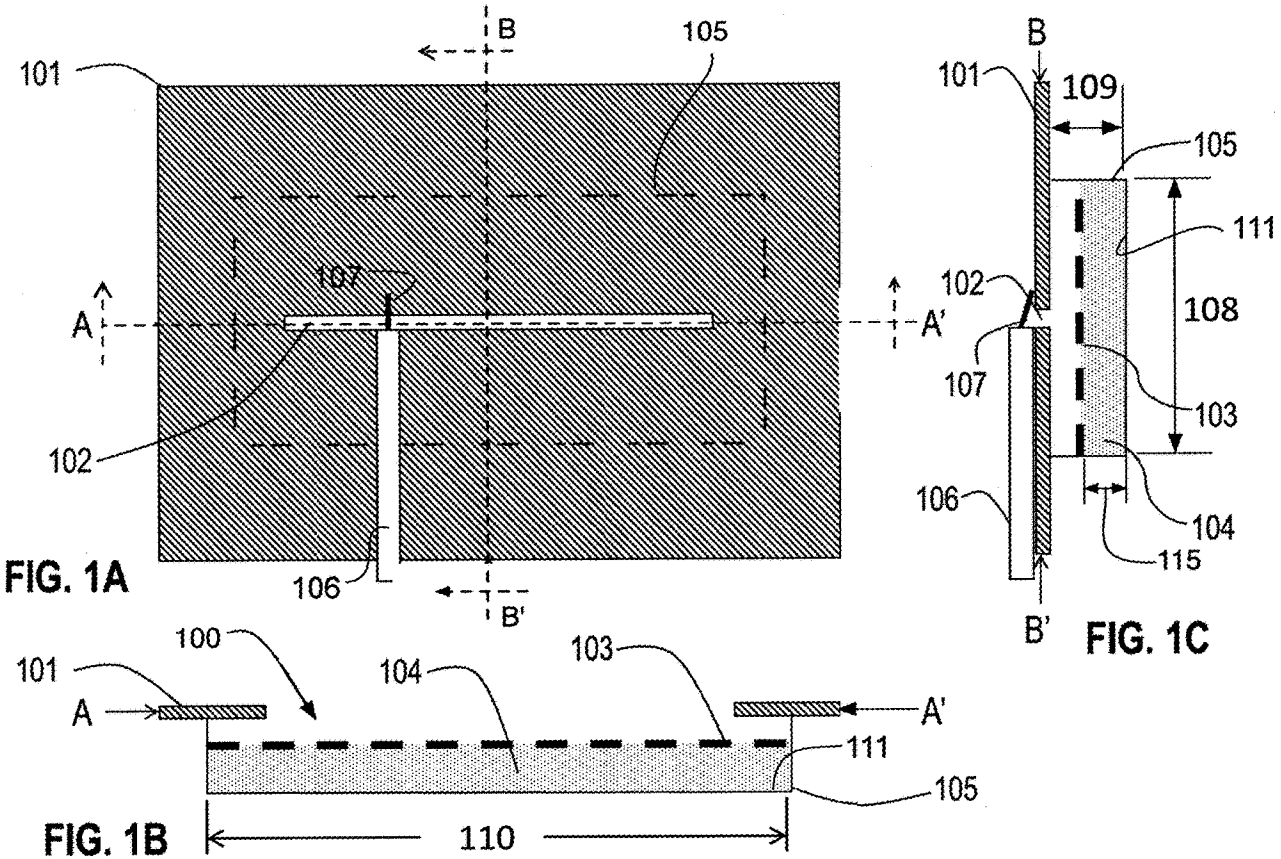
FIGS. 1A, 1B and 1C depict atop view and two sectional views, respectively, of an embodiment of a cavity-backed slot antenna (CBSA) loaded with an active artificial magnetic conductor (AAMC)

Referring to FIGS. 1A, 1B and 1C, FIG. 1A depicts a top view of the AAMC-CBSA while FIGS. 1B and 1C depict side sectional views taken along lines A-A' and B-B' shown in FIG. 1A. The AAMC-CBSA is formed by a slot 102 in a metal plate 101 which typically acts as a ground plane for the antenna. The slot 102 is open to a cavity 100 below it (it is open in an electrical sense in that the slot 102 and/or the cavity 100 below it may be filled or partially filled with an electrically transparent or translucent material such as a dielectric material).

An AMC 103 is disposed in the cavity 100 and preferably fills the cavity by extending towards all four sides of the cavity 100, the sides of the cavity 100 comprising cavity walls 105 which are represented by the dashed lines associated with numeral 105 in FIG. 1A and solid lines 105 in FIGS. 1B and 1C. The AMC 103 may comprise a reactive metallic grid of patches (see, e.g., patches 204 in FIG. 2), for example, and preferably has a dielectric substrate 104 disposed preferably below, but usually on at least one side of the grid of patches, preferably to provide a physical support for the patches. The patches may also or alternatively be supported directly or indirectly by the walls 105 of the cavity 100. When loaded with active circuits, such as NFCs, then the AMC 103 can be called a AAMC. The AMC 103 is preferably disposed a fixed distance 115 above the floor 111 of the cavity 100.

The length 110 of the cavity 100 is approximately one wavelength long for the desired radiation frequency which the antenna transmits and/or receives, while the width 108 of the cavity 100 is less in this embodiment (but lengths 108, 110 of the cavity 100 could be the same size or nearly the same size in other embodiments). The slot 108 can be as long as the cavity 100 or shorter than the cavity 100 (as is the case in FIGS. 1A and 1B), but preferably it should not be longer than the cavity 100. The width of slot 102 is usually very narrow compared to the cavity's width 108. The CBSA can be excited in a variety of ways well known in the art. One embodiment according to the principles of the present invention uses a coaxial cable 106 whose ground shield is coupled (for example, by soldering) to one side of the slot 102 while the coax cable's center conductor 107 is connected (for example, by soldering) to the other side of the slot 102.

The width 108 and depth 109 of the cavity can be any convenient size. However, in order to make a low-profile antenna, it is preferable if the width 108 and the depth 109 of the of the cavity 100 are less than 1/10 a wavelength for the desired radiation frequency.

Figure 2:
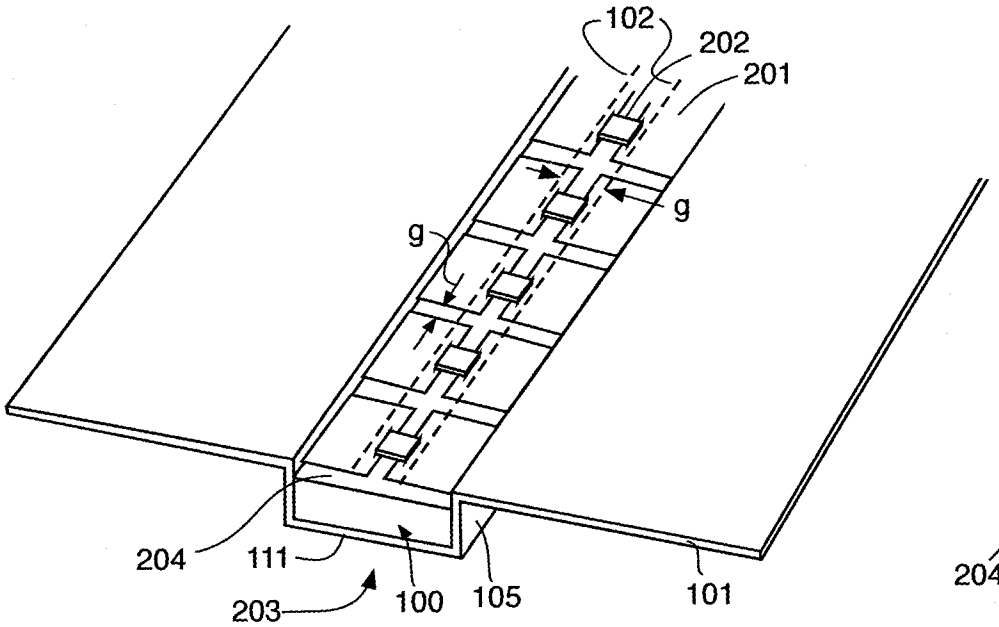
FIG. 2 is a perspective view of the cavity showing one embodiment of an AAMC therein.

Referring to FIG. 2, an AMC 203 is shown in this cutaway three dimensional view sitting in the cavity 100, but this embodiment of the AMC 203 has a different aspect ratio (length to width) compared to the AMC 103 of FIGS. 1A-1C. Also the slot 102 depicted in FIGS. 1A-1C is only shown as two dashed lines 102 in this figure to better show the details of the AMC 203 below the slot 102 in this embodiment. This embodiment includes a slot 102 which has a width smaller than the width (108 in FIG. 1C) of the depicted AMC 203 that sits inside the cavity 100 a set distance (115 in FIG. 1C) above the floor 111 of the cavity 100. In this embodiment the AMC 203 is formed by a plurality of metallic patches 201 disposed on a dielectric substrate 204 (dielectric substrate 204 may serve same the function as the dielectric substrate 104 mentioned above). The substrate 204 can be circuit board material or it can fill all or a portion of the cavity 100. The patches 201 in the AMC 203 of this embodiment are aligned in two columns along the length of the cavity 100, with a gap g between adjacent patches 201 in each column and in each row thereof. The two columns span the width (108 in FIG. 1C) of the cavity 100. The size of the patches and the gap g between them, and the distance (115 in FIG. 1C) between the array of patches 201 and the cavity floor (111 in FIG. 1C) all influence the resonant frequency and bandwidth of the antenna, as is well known to those familiar with AMC technology. The patch 201 shape also affects the antenna performance. In the accompanying figures, and in a test article discussed below, embodiments of the principles of the present invention use rectangular patches but other geometric shapes can be used if desired for patches 201. The sides of the patches 201 in the embodiment of FIG. 2 are electrically connected to the walls of the CBSA cavity 100.

Figure 3:
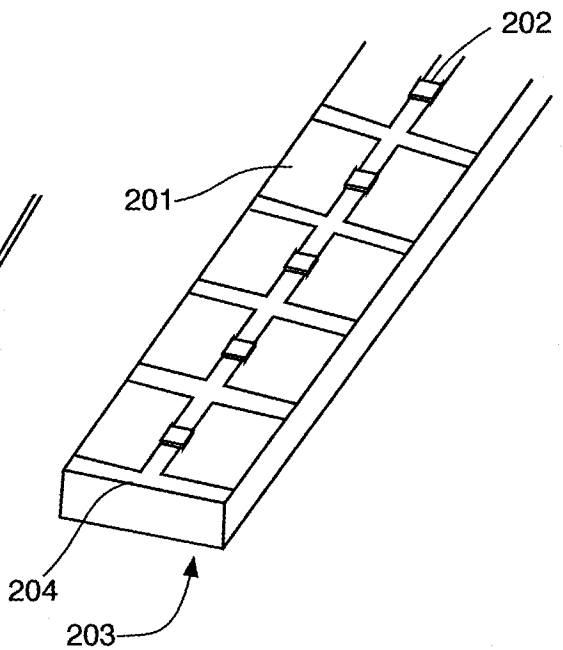
FIG. 3 is a perspective view of the AAMC that is inserted into the antenna cavity of FIG. 2, for example.
Figure 4:
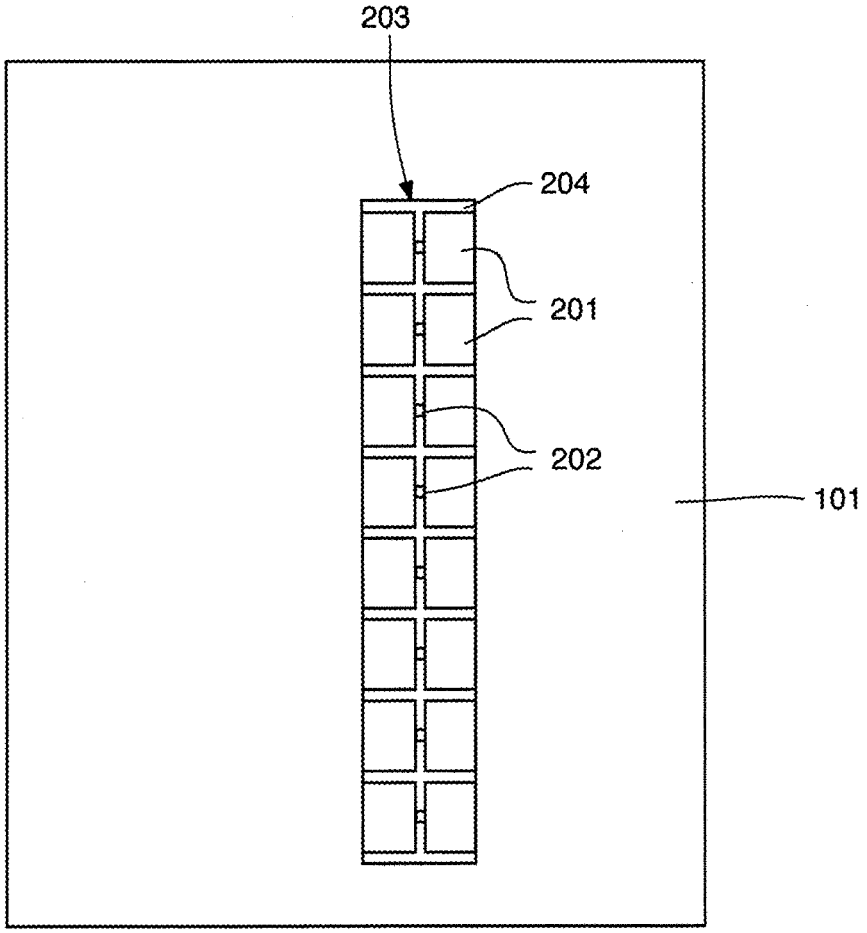
FIG. 4 is a top view of the AAMC inside the antenna cavity.
Figure 5:
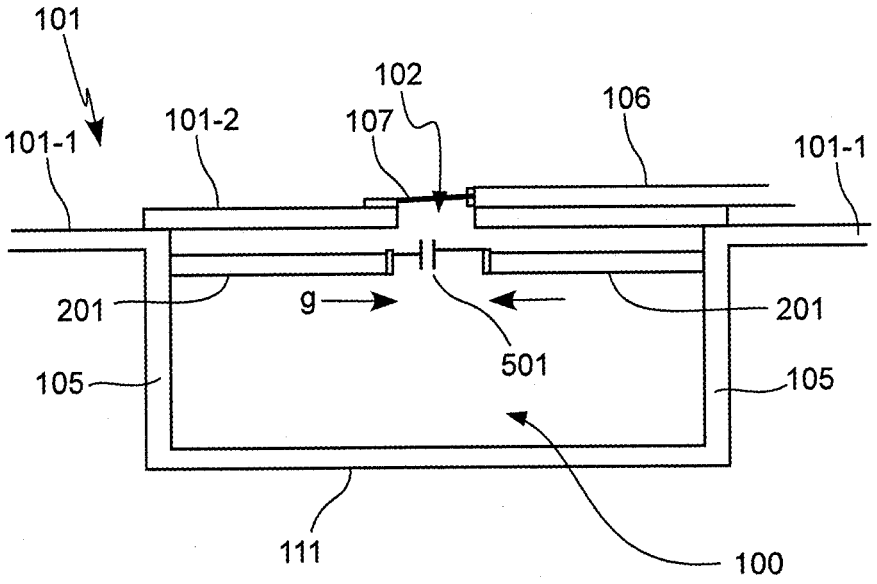
FIG. 5 is a side elevational view through an embodiment of the slot showing two patches of the array of patches with a fixed reactive element coupling them in the cavity behind the slot and a coaxial feed across the slot.
Figure 6:
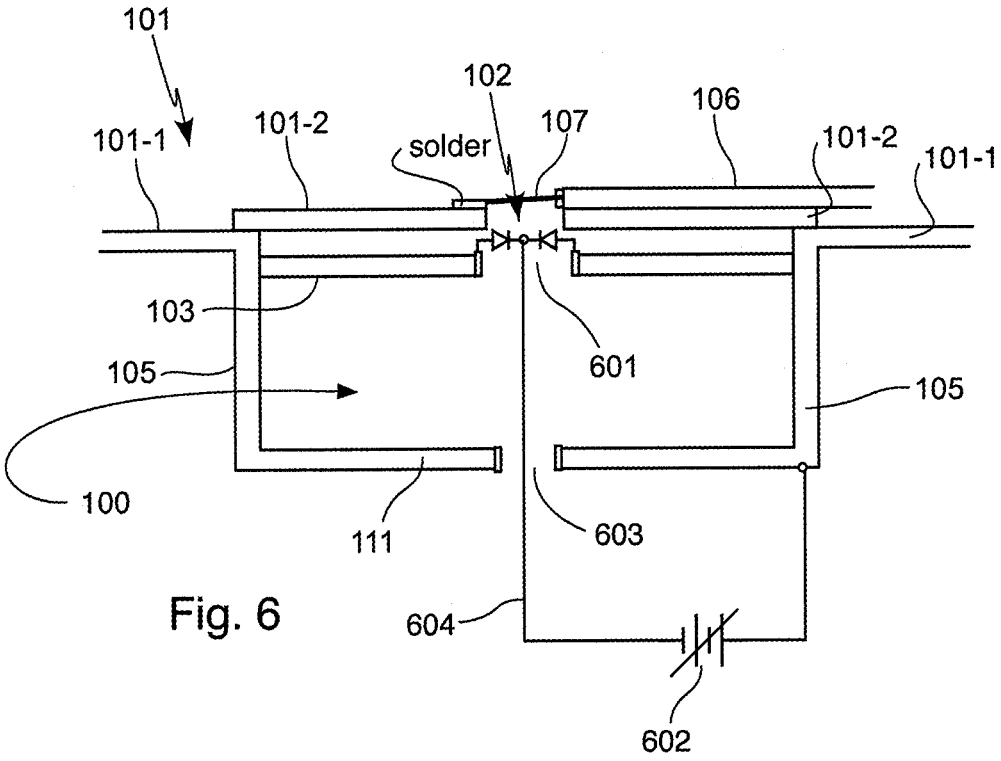
FIG. 6 is a side elevational view through an embodiment of the slot showing two patches of the array of patches with a variable reactive element coupling them in the cavity behind the slot.
Figure 7:
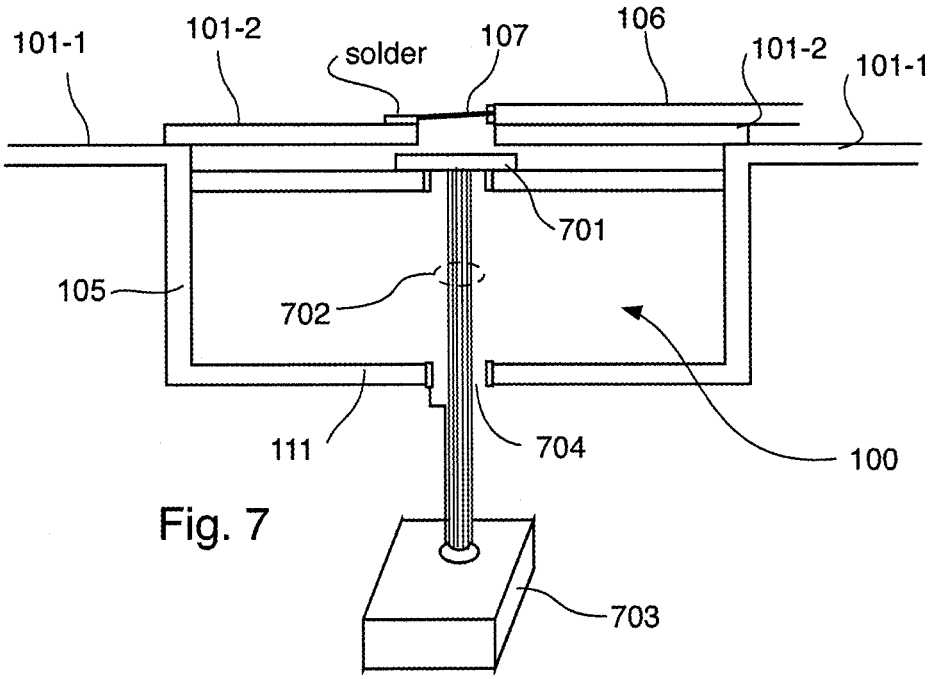
FIG. 7 is a side elevational view through an embodiment of the slot showing two patches of the array of patches with a variable non-Foster circuit element coupling them in the cavity behind the slot.

FIG. 3 shows the AMC of FIG. 2 but with plate 101 and cavity 100 omitted for ease of illustration. Pairs of patches 201 are connected by a reactive element 202 as shown in FIGS. 2 and 3. FIG. 4 shows a top view of the embodiment in FIGS. 2 and 3. Alternative embodiments may use various reactive elements 202. For example, and not to imply a limitation, each reactive element 202 can be embodied as capacitive element such as a fixed capacitor 501 as shown in FIG. 5, or as a variable varactor 601 as shown in FIG. 6, or as an active non-Foster circuit 701 as shown in FIG. 7. In the case where a fixed capacitor 501 is used to load the grid, the CBSA's resonant frequency can be lowered to a much lower frequency than a CBSA with an unloaded cavity, but the bandwidth decreases as the frequency is lowered. The higher the capacitance value used, the lower the frequency. The variable varactor 601 in FIG. 6 may be formed of two diodes biased by an adjustable control voltage 602 applied to conductor 604.

FIG. 5 is a side elevation view through the CBSA showing one of the the capacitors 501 and also the shows the CBSA being excited by cable 106. In this embodiment member 101 of FIGS. 1A-1C is formed from two pieces of metal 101-1 and 101-2. Metal 101-2 is electrically connected to metal 101-1 by soldering or attachment means (including mechanical attachment), for example. The patches 201 are shown as being mounted directly to the vertical walls 105 of cavity 100 so that the sides of the patches 201 facing the walls 105 of the cavity are electrically coupled thereto. In this embodiment there is no need for the dielectric substrate 104 to support patches 201, but the dielectric substrate 104 may be utilized if desired. This embodiment typically has a plurality of patches 201 preferably arranged in two columns with a number of rows as depicted in FIG. 2.

FIG. 5 shows the width of the slot 105 and the spacing g of the patches 201. There is no relationship between the width of the slot 105 and the spacing g of the patches 201. In the test prototype of FIG. 9, the slot 105 width is 0.170", while the gap g between patches is 0.400".

The patches 201 can be located any distance away from surface 101-2. But, ideally, the patches 201 are disposed very close to the plane of slot 102 because that enables the cavity depth to be a kept to a minimum.

Figure 8:
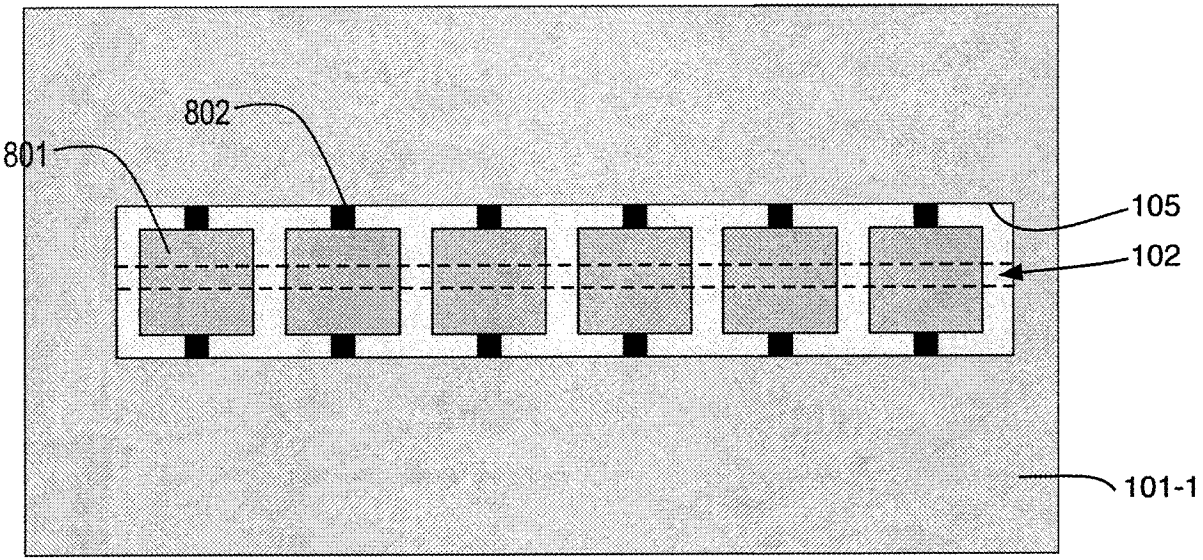
FIG. 8 is an alternative design, similar to that of FIG. 4, but in this case the reactive elements couple the sides of a single row of patches to the walls of the cavity.
Figure 9A:
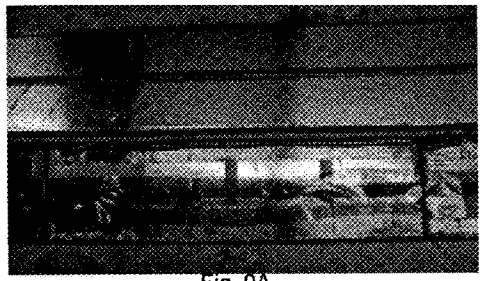
FIGS. 9A-9E are photographs of a AAMC-CBSA test article which was made and tested.
Figure 9B:
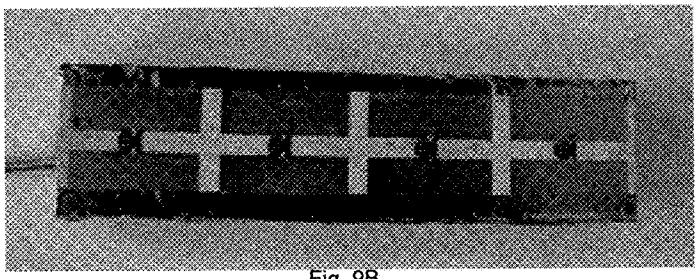
Figure 9C:
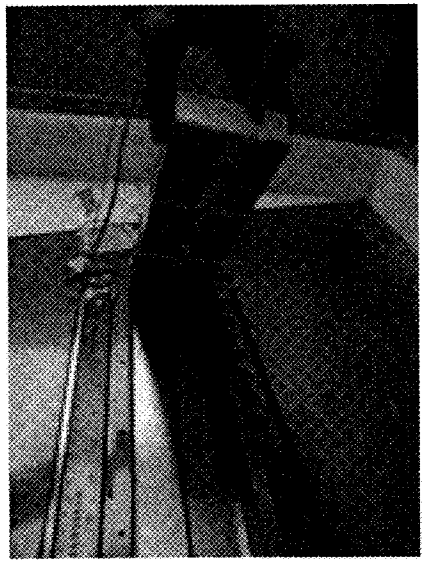
Figure 9D:
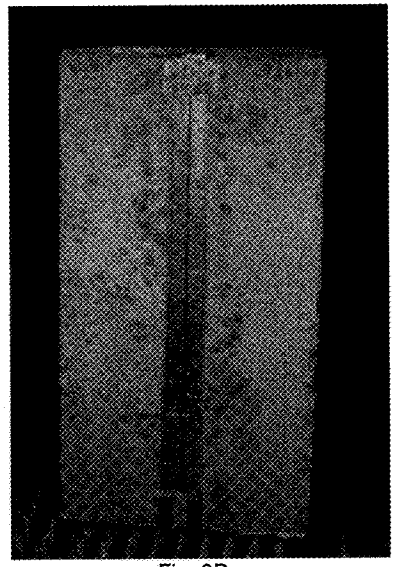
Figure 9E:
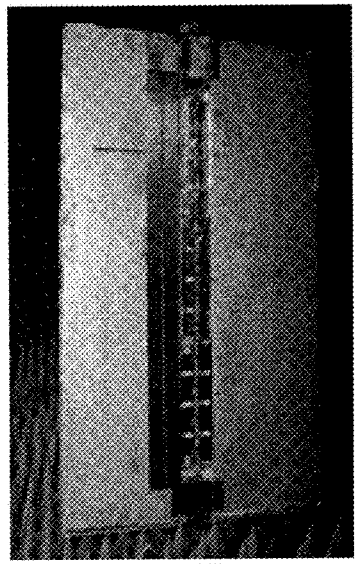

In another embodiment, illustrated by FIG. 8, the AMC (103 in FIG. 1B) can be formed with a single column of patches (numbered 801 in this embodiment) centered on the elongate axis of the cavity 100, and the reactive elements (numbered 802 in this embodiment) are electrically connected between the patches 801 and each side of the vertical walls 105 of cavity 100. The disadvantage of this configuration is that it requires twice as many reactive elements 802 compared to the embodiment of FIG. 4. In this figure, metal 101-2 is omitted for clarity's sake, but the slot 102 therein is represented by the two dashed lines.

Turning again to FIG. 6, when the AMC 203 is loaded with a plurality of variable varactors 601 (each reactive element 202 of FIG. 2 in the embodiment of FIG. 6 is embodied as a variable varactor 601 in this embodiment, FIG. 6 showing a cross section view through one of the pairs of patches 201), it adds a capacitance to the grid of patches, and it has the same effect on the CBSA performance as the capacitor 501 of FIG. 5, but the varactor 601 it is tunable by an applied voltage 602. The adjustable variable reactor 601 allows the CBSA frequency of maximum antenna gain and efficiency to be tuned over a wide frequency band. The voltage 602 can be applied by running a wire to the varactor through an opening 603 in the bottom of the CBSA cavity 100. A simple control scheme is shown in FIG. 6, where two varactors 601 are connected cathode to cathode to provide the variable capacitance. Such cathode to cathode varactors are available in a three-lead package from most varactor manufacturers (e.g. Skyworks).

When the AMC is loaded with NFCs 701 (as shown in FIG. 7), there are a number of control lines or wires 702 that supply voltages to the NFC 701. Those lines or wires 702 are connected preferably to a multi-source voltage supply 703 through an opening 704 in the bottom of the CBSA cavity 100. The preferred negative inductance varies with the cavity dimensions, the AMC dimensions and the preferred operation frequency. For operation at a given frequency f, the AMC's equivalent circuit parameters of inductance L and capacitance C satisfy the equation for a parallel LC circuit resonance, $f=1/(2\pi\sqrt{LC})$ where the capacitance is due to a combination of the edge-to-edge capacitance between the metal patches and the parallel-plate capacitance between the patches and the AMC's ground plane 101. The inductance is the parallel combination of the substrate inductance and the load inductance. The substrate inductance is approximately $L_{sub}$=8.8d nH*d where d is the AMC thickness in cm. Then the negative inductance is limited to be less than the negative of $L_{sub}$, i.e. LNFC<$-L_{sub}$. So a preferred range is −30 nH*d(cm)<LNFc<−8.8 nH*d(cm)

The NFC 701 has been implemented in the test article of FIG. 9 as a Negative Impedance Inverter having a negative inductance between −70 and −45 nanohenrys and a negative resistance of −7 to −4 ohms as described in "Wideband Artificial Magnetic Conductors Loaded With Non-Foster Negative Inductors" by Gregoire et al. IEEE Antennas and Wireless Propagation Letters Vol. 10, 2011, which is incorporated by reference herein.

Figure 11A:
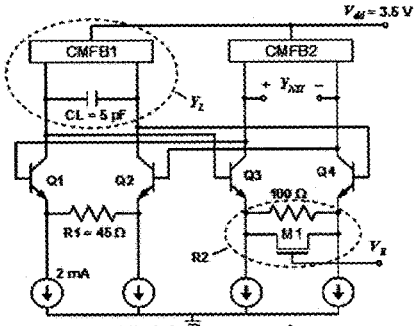
FIG. 11A is a schematic diagram of a preferred embodiment of a Non-Foster Circuit.

A schematic diagram of the preferred embodiment of the NFC 701 is shown by FIG. 11A and that NFC is described in greater detail in U.S. patent application Ser. No. 13/441,730 filed Apr. 6, 2012 and entitled "Differential Negative Impedance Converters and Inverters with Tunable Conversion Ratios", the disclosure of which is hereby incorporated by reference.

FIGS. 9A-9E are photos of an AAMC-CBSA test article. In this embodiment the cavity is 39 inches long (dimension 110 in FIG. 1B), by 3 inches wide (dimension 108 in FIG. 1C) and 1.5 inches deep (dimension 109 in FIG. 1C). The size of the slot 102 is 39 inches long by 0.170 inches wide. Dielectric 105 (see element 104 in FIG. 1B) preferably is 1 inch thick Rohacell structural foam so the grid of patches of the AMC 103 is located 0.5 inch below the plane of the slot. The ground plane 101 (metal 101-1 and 101-2 together) is 48 inches by 36 inches in this test article. This embodiment uses NFCs 701 as shown in FIG. 11A for the AMC.

Figure 10A:
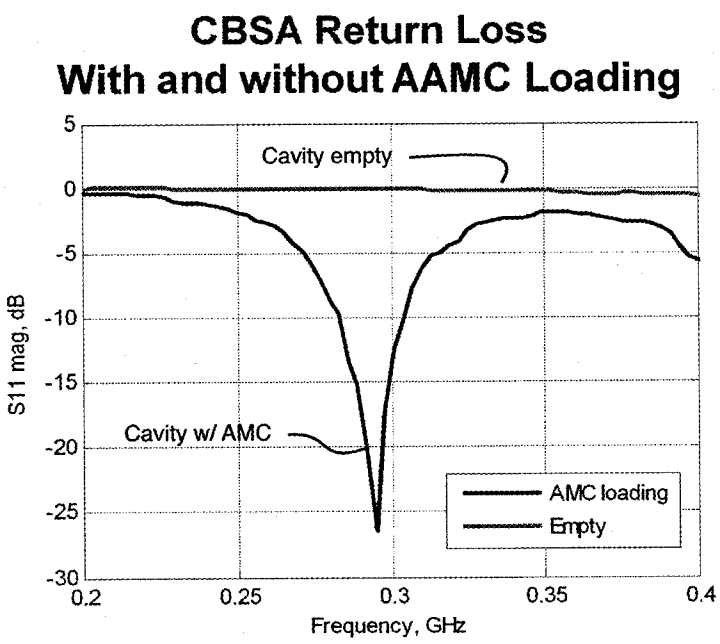
FIGS. 10A and 10B are graphs depicting the test results for the AAMC-CBSA test article of FIGS. 9A-9E.
Figure 10B:
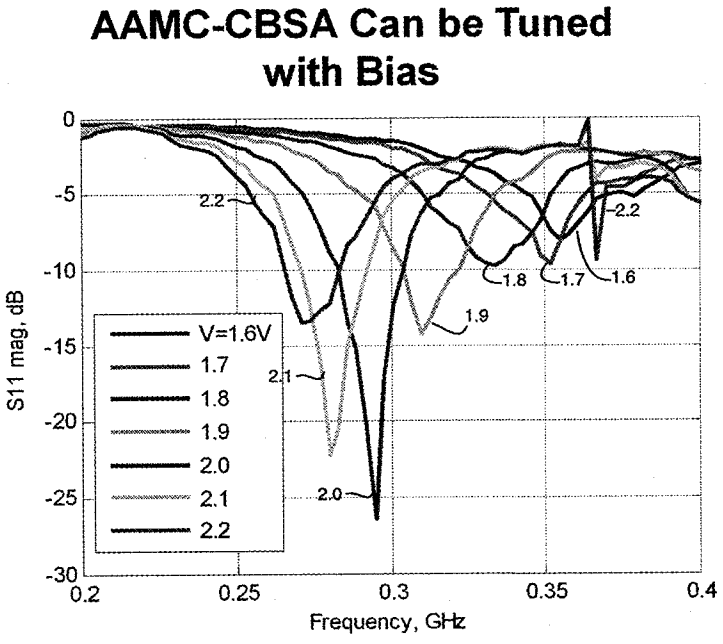

FIGS. 10A and 10B are plots of the measured input reflection coefficient magnitude of the AAMC-CBSA test article of FIGS. 9A-9E. FIG. 10A compares the unloaded cavity to the NFC AAMC at 2.0-volt bias. FIG. 10B shows the response of the NFC AAMC with different biases from 1.5 to 2.2 volts. This data shows the input match of the CBSA in the VHF/UHF band is significantly improved in the VHF/UHF band with the NFC AAMC loading, and it can be tuned over a wide range.

Figure 11B:
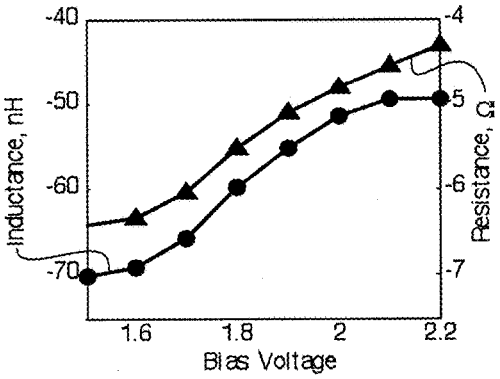
FIGS. 11B and 11C depict measured circuit values for the NFC of FIG. 11A.
Figure 11C:
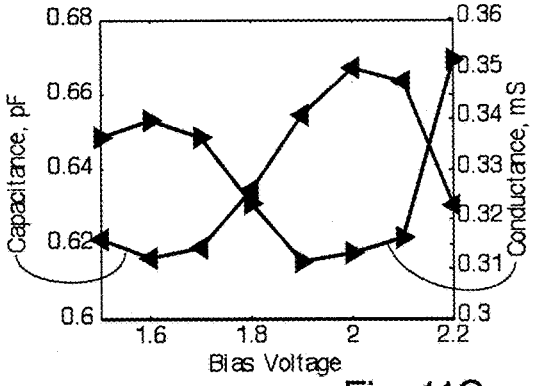

FIG. 11A is a schematic diagram of preferred embodiment of a NFC, which NFC is described in detail in U.S. patent application Ser. No. 13/441,730 filed Apr. 6, 2012 and entitled "Differential Negative Impedance Converters and Inverters with Tunable Conversion Ratios", the disclosure of which is hereby incorporated by reference. FIGS. 11B and 11C depict measured circuit values for the NFC 701 used in the AAMC-CBSA test article of FIGS. 10A-10E.

This concludes the description of a number of embodiment of the present invention. The foregoing description of these embodiments of the invention has been presented for the purposes of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

What is claimed is:

1. A cavity-backed slot antenna having a cavity therein, the cavity-backed slot antenna comprising an artificial magnetic conductor (AMC) disposed in said cavity-backed slot antenna, the AMC being formed by an array of metal patches displaced by a distance above a bottom of said cavity, the metal patches have edges confronting sidewalls of the cavity, said edges being electrically connected to said sidewalls, the AMC being loaded with active reactive elements.

2. The cavity-backed slot antenna of claim 1 where the metal patches are arrayed on two columns running along a length of the cavity, with a gap between the columns.

3. The cavity-backed slot antenna of claim 2 where the reactive elements are electrically connected in the gap between the columns of patches.

4. The cavity-backed slot antenna of claim 1 wherein said active reactive elements are Non-Foster Circuits.

5. The cavity-backed slot antenna of claim 1 wherein said active reactive elements are varactors.

6. The cavity-backed slot antenna of claim 1 wherein said reactive elements are negative-inductance non-Foster circuits.

7. The cavity-backed slot antenna of claim 5 with a variable voltage source connected to the varactors.

8. The cavity-backed slot antenna of claim 6 where the NFC's inductance is tunable with an applied voltage.

9. The cavity-backed slot antenna of claim 1 where the patches are arrayed in a single column centered along the length of the cavity.

10. The cavity-backed slot antenna of claim 8 where two reactive elements are electrically connected between each patch and either side of sidewalls of the cavity.

11. A cavity-backed slot antenna whose cavity has an artificial magnetic conductor (AMC) disposed therein, the AMC comprising an array of metal patches displaced by a set distance above a bottom of said cavity, the metal patches being arrayed in two columns running along a length of the cavity, and with a gap between the columns, the metal patches having edges confronting sidewalls of the cavity, said edges being electrically connected to said sidewalls, each gap between neighboring patches being bridged by reactive elements.

12. The cavity-backed slot antenna of claim 11 wherein the reactive elements comprise Non-Foster Circuits.

13. A cavity-backed slot antenna having a cavity therein, the cavity-backed slot antenna comprising an artificial magnetic conductor (AMC) disposed in said cavity-backed slot antenna, the AMC comprising an array of metal patches displaced by a set distance above a bottom of said cavity, the metal patches being arrayed in a single column running along a length of the cavity, and with a gap between the column and sidewalls of the cavity, the metal patches having edges confronting sidewalls of the cavity, said edges being electrically coupled to said sidewalls via reactive elements.

14. The cavity-backed slot antenna of claim 13 wherein the reactive elements comprise Non-Foster Circuits.

15. A method of lowering a resonant frequency of a cavity backed slot antenna comprising the steps of:

(i) disposing an array of electrically conductive patches in a cavity of said cavity backed slot antenna adjacent a slot of said cavity backed slot antenna, the array of electrically conductive patches forming an artificial magnetic conductor;

(ii) coupling capacitive elements between said plurality of electrically conductive patches and an electrically conductive wall defining at least two edges of said cavity.

16. A method of increasing the bandwidth around a resonant frequency of a cavity backed slot antenna comprising the steps of:

(i) disposing an array of electrically conductive patches in a cavity of said cavity backed slot antenna adjacent a slot of said cavity backed slot antenna, the array of electrically conductive patches forming an artificial magnetic conductor;

(ii) coupling capacitive elements between said plurality of electrically conductive patches and an electrically conductive wall defining at least two edges of said cavity, said capacitive elements each having a negative capacitance.

17. The method of claim 16 wherein said capacitive elements also have a negative resistance associated therewith so that both said negative capacitance and said negative resistance is imposed between said plurality of electrically conductive patches and an electrically conductive wall defining at least two edges of said cavity.

* * * * *